United States Patent [19]

Mykolenko

[11] 3,988,917

[45] Nov. 2, 1976

[54] APPARATUS AND METHOD FOR MAKING A CHEVRON MATRIX STRIP

[75] Inventor: Petro Mykolenko, Warren, Mich.

[73] Assignee: General Motors Corporation, Detroit, Mich.

[22] Filed: June 25, 1975

[21] Appl. No.: 590,391

[52] U.S. Cl. ..... 72/187; 72/196; 113/118 R

[51] Int. Cl.[2] ..... B21D 13/10

[58] Field of Search ..... 72/187, 196; 165/152; 113/1 C, 118 R

[56] References Cited

UNITED STATES PATENTS

| | | | |
|---|---|---|---|
| 767,883 | 8/1904 | Grafton | 72/187 |
| 1,937,466 | 11/1933 | Smith et al. | 72/187 |
| 2,329,789 | 9/1943 | Schank et al. | 72/187 |
| 2,684,707 | 7/1954 | Getz | 72/187 |

*Primary Examiner*—Lowell A. Larson
*Attorney, Agent, or Firm*—Arthur N. Krein

[57] ABSTRACT

An apparatus and method for forming an indefinite length of flat strip material into a chevron-shaped matrix strip element used in the fabrication of a heat exchange matrix disk for a rotary regenerator heat exchange apparatus, or similar device, in which the chevron matrix strip is formed by passing the flat strip material between the mating shaped teeth of a pair of preforming rolls which preform the chevron shape and coin chevron break lines in this material, the thus preformed matrix strip then being advanced through a guide passage between a pair of gathering rolls which feed (gather-form) the matrix strip and at the exit of this passage a pair of indexing rolls are positioned to control (index) the matrix feed-out of the passage, all of these elements being suitably supported on a suitable frame with the separate sets of rolls being driven in predetermined timed relation to each other.

5 Claims, 9 Drawing Figures

APPARATUS AND METHOD FOR MAKING A CHEVRON MATRIX STRIP

This invention relates to an apparatus and method for making a heat exchange element and, in particular, to an apparatus and method for fabricating a chevron matrix strip from flat strip material.

Rotary regenerators, particularly of the axial flow type, as used in gas turbine engines, utilize heat transfer means in the form of a porous metal disk matrix which is rotated so that each element thereof passes successively through two aeriform fluid flow paths, absorbing heat from a hotter fluid and releasing it to a cooler fluid in these flow paths.

Metal matrices ordinarily are made up of crimped or corrugated metal sheets spirally wound into a disk and then brazed or otherwise bonded together so as to provide a rigid cellular or porous structure.

The conventional inner core structure or main heat transfer body of such an axial flow regenerator matrix disk involves alternating flat and corrugated strips or alternating corrugated strips which are spirally wound about a hub to form the main heat transfer body of the matrix. One example of such an alternating flat strip and corrugated strip structure is illustrated in U.S. Pat. No. 3,276,515 for "Gas Turbine Regenerator" issued Oct. 4, 1966 to James H. Whitfield. An example of a matrix structure using alternating corrugated strips, one of which has deep corrugations and the other shallow corrugations, is illustrated in U.S. Pat. No. 3,532,157 entitled "Regenerator Disk" issued Oct. 6, 1970 to William S. Hubble.

Each wrap of the deeply corrugated strip together with the flat strips or strips having corrugations of a reduced height as compared to the deeply corrugated strip, fixed on opposite sides of the deeply corrugated strip, defines flow passages extending generally axially of the matrix through the deep corrugations.

It has now been proposed to utilize a chevron-shaped matrix element in lieu of a deeply corrugated strip in the fabrication of a heat exchange core element, such as a matrix disk for a rotary regenerator.

It is therefore a primary object of this invention to provide an apparatus and method whereby to continuously roll form a chevron matrix strip for use in a heat exchanger core.

Another object of this invention is to provide an apparatus and method for forming from an indefinite length of flat strip material, a chevron-shaped strip of material usable as a core element in a rotary regenerator heat exchange apparatus.

A further object of this invention is to provide an apparatus and method for fabricating a chevron matrix strip, whereby flat stock strip material is first performed into the chevron shape, then gathered into an over-formed state and then indexed to its final chevron configuration.

These and other objects of this invention are obtained by transporting a web of flat material endwise between a pair of rotatably supported preforming rolls, each preforming roll having a tooth form on the outer periphery thereof in mating engagement with the tooth form on the other roll whereby to partly deform and coin the flat strip material fed therebetween into a preformed strip, guiding the preformed strip through a passage between a pair of rotatably supported gathering rolls, each of the gathering rolls having complementary shaped gathering tooth forms thereon to effect gathering and feeding of the preformed strip as it passes through the gathering rolls, into a restricted throat portion of the passage for discharge to a pair of spaced apart rotatably supported index rolls downstream of the passage, each of the index rolls having a plurality of sharp-tipped tooth forms on the outer periphery thereof to effect proper spacing and indexing of the previously formed chevron fins on the strip material into the final chevron shape, the apparatus having drive means operatively connected to the preforming rolls, the gathering rolls and the indexing rolls to effect rotation of the different sets of rolls at predetermined speeds relative to each other.

For a better understanding of the invention, as well as other objects and further features thereof, reference is had to the following detailed description of the invention to be read in connection with the accompanying drawings, wherein.

Figure 7:
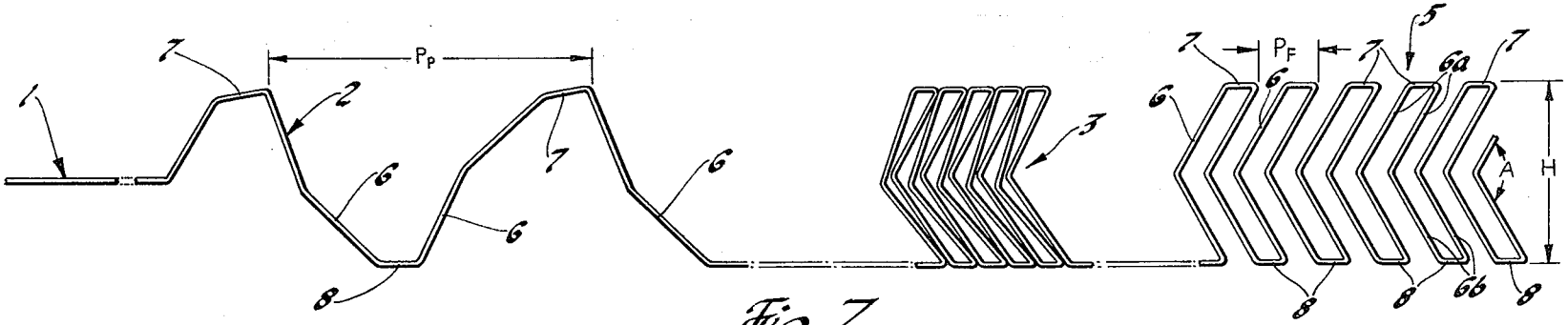
FIG. 7 is an enlarged side elevation view of the fabrication sequence in the formation of a chevron strip from flat strip sheet material.

Referring first to FIG. 7, the chevron matrix strip, generally designated 5, made from flat strip material 1, in its finished fabricated form, as seen on the right-hand side of FIG. 7, includes closely spaced apart, substantially parallel fins 6 interconnected to each other at alternating ends, each fin 6 including diagonal first and second fin portions **6*a* and 6*b*, respectively, meeting together at an obtuse angle A, with each first fin portion 6*a* of a fin being connected by a flat crest 7 to the first fin portion 6*a* of the next adjacent fin on one side thereof and the second fin portion 6*b* thereof being connected by a flat valley 8 to the second fin portion of the next adjacent fin on the opposite side thereof, the included angle A between each first and second fin portion of a fin being approximately 120° and the flat crests 7 and flat valleys 8** being substantially parallel to each other.

In a preferred embodiment wherein the chevron strip is to be used in the fabrication of a matrix disc for a rotary regenerator, the flat strip material 1, from which the chevron strip is made, is a 0.002 inch thick foil having a width of three inches, and the finished chevron matrix strip 5, fabricated from this strip material, had ninety-three fins per 2 inches of chevron matrix strip and the height of the chevron matrix strip, that is, the distance from a flat crest 7 to a flat valley 8, was 0.129 inch. Accordingly, it will be realized that the material shown in FIG. 7 has been greatly enlarged.

In the process of forming the strip material 1 into the chevron matrix, it is first preformed as shown at 2 and then this preformed material is gathered into an overformed state as shown at 3 after which it is indexed, as described hereinafter, into its free (not constrained) final form 5 as shown at the right-hand side of FIG. 7, the configuration previously described.

Referring now to the subject apparatus of the invention, a brief preliminary explanation is given of the main elements of the apparatus, the apparatus including a suitable frame structure, generally designated 10, which rotatably supports a pair of preforming rolls 11 and 11*a*, defining a strip preforming station at which a flat strip of material, guided from a suitable supply roll, not shown, into the bight between these rolls by a guide table 12 on the input side of these preforming rolls, is preformed. Next in succession, the preformed strip delivered from the preforming rolls via a discharge guide table 13 is allowed to bend into a supply loop, the strip then being guided through an inlet passage provided by a pair of spaced apart guide plates 14 and 14*a*, on the frame structure, into the bight of a pair of gathering rolls 15 and 15*a* suitably rotatably supported to define a gathering station, the strip material in gathered form discharged from the pair of gathering rolls then being fed into a restricted throat passage 16 provided by the guide plates 14 and 14*a* and then into the gap between a pair of indexing rolls 17 and 17*a*, these index rolls also being suitably rotatably supported on the frame structure, these indexing rolls defining an indexing station. The fully formed chevron strip discharged from the indexing rolls is guided between guide plates 18 and 18*a* forming a discharge station, for discharge from the machine to a suitable storage element, which for example may take the form of a take-up roll, not shown, since it forms no part of the invention.

In the embodiment illustrated, the frame structure 10 includes a primary base 20 and a secondary base 21 that are suitably connected together at their lower extremities, not shown, to in effect provide a unit type base support. The primary base 20 carries an upper frame structure which includes primary and secondary table elements 22 and 22*a*, respectively, suitably secured together with the lower ends of the upright left and right-hand frame plates 23 and 24, respectively, as viewed from the discharge end of the apparatus, of this structure rigidly secured to secondary table 22*a* in spaced apart parallel relation to each other, and a cross plate 25 that is secured to the upper ends of these frame plates to maintain this relationship of the upright frame plates.

Figure 1:
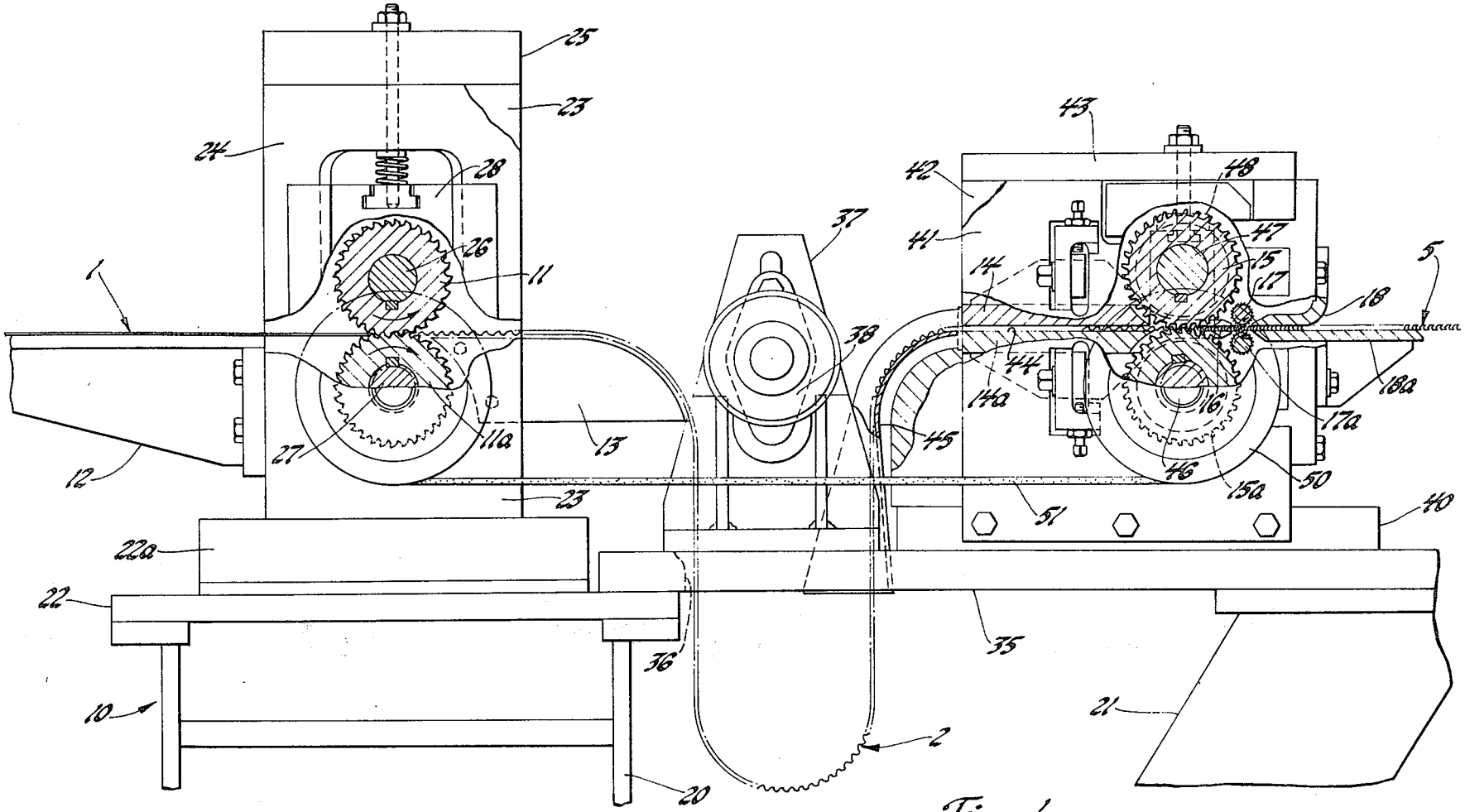
FIG. 1 is a side elevation view of a preferred embodiment of the apparatus of the invention with parts broken away to show in section the major operating elements of the apparatus.
Figure 2:
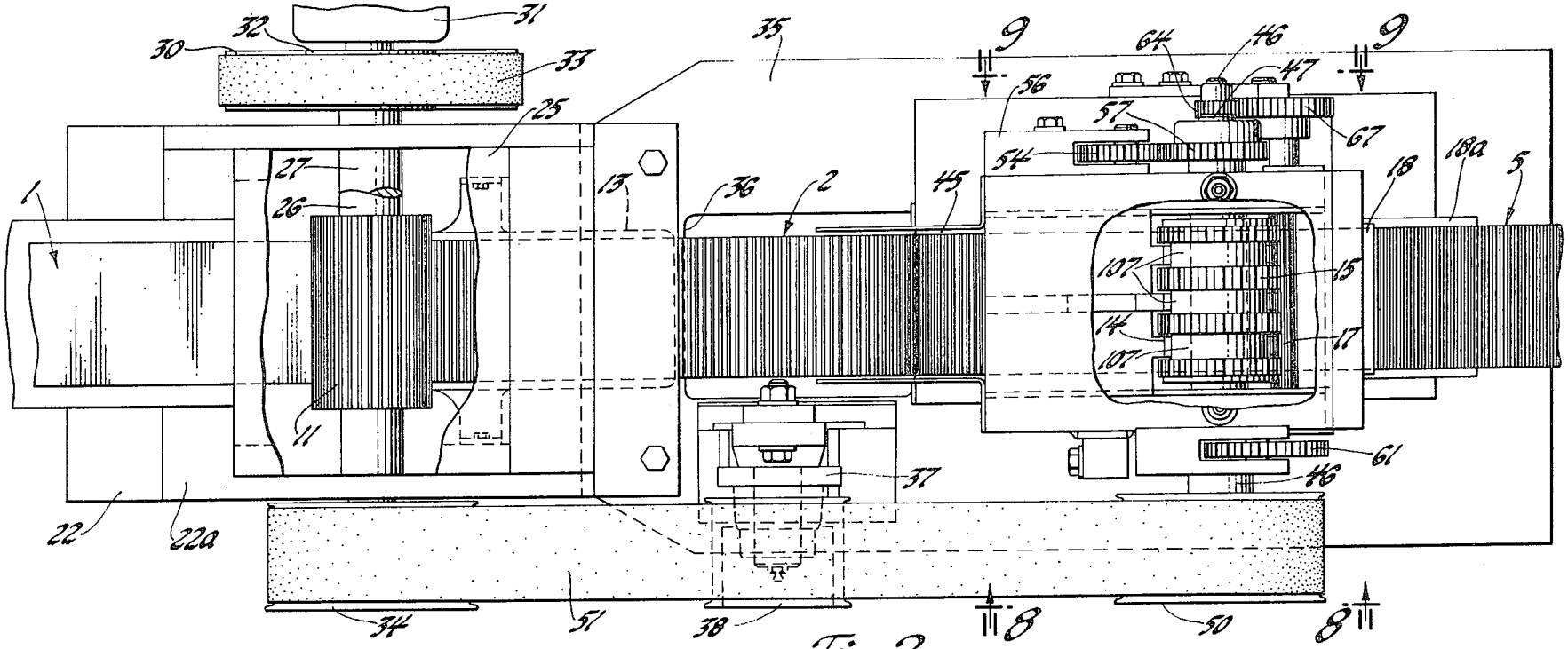
FIG. 2 is a top plan view of the apparatus of FIG. 1 with parts broken away to show details of the apparatus.

As best seen in FIGS. 1 and 2, the preforming roll 11, which is the upper roll in a set of these rolls, is keyed to a shaft 26 rotatably supported at opposite ends by the frame plates 23 and 24 whereby the preforming roll 11 with its tooth form on the outer periphery thereof has its teeth meshing, as described hereinafter, with corresponding teeth on the outer periphery of the roll 11*a*, the roll 11*a* being keyed to a shaft 27 for rotation therewith. As best seen in FIG. 1, in the embodiment illustrated, the shaft 26 is preferably rotatably supported at opposite ends by a pair of pillow blocks 28, only one of which is shown, slidably and adjustably positioned in suitable guideways provided for this purpose in the frame plates 23 and 24 while the shaft 27 is rotatably supported in the frame plates 23 and 24 with the ends of this shaft extending through these frame plates. As shown, the right-hand end of the shaft 27 projects outward from the frame plate 24 sufficiently to have a gear tooth driven pulley 30 fixed thereon whereby this shaft can be driven as by a suitable power source as, for example, motor 31 having a gear tooth pulley 32 fixed on its output shaft, the pulleys 30 and 32 being operatively connected together by a suitable gear toothed endless belt 33. The left-hand end of the shaft 27 extending out through the frame plate 23 has a gear tooth pulley 34 fixed thereon for a purpose to be described.

Preformed strip material is discharged from the preforming rolls onto the discharge guide table 13 suitably secured to frame plates 23 and 24 to extend therebetween.

As shown in FIG. 1, a bridge plate 35 is connected at one end to the secondary base 21 and at its opposite end is suitably secured to the primary table 22 whereby to bridge the gap between the bases 20 and 21. Adjacent to its left end, as seen in FIGS. 1 and 2, the bridge plate is provided with a suitable aperture 36 whereby the preformed strip of material discharged from the preforming rolls can be formed into a free formed loop, which in effect is a supply source of material, before it is fed into the gathering rolls 15 and 15*a*. In addition, intermediate its ends, the bridge plate supports an upright idler standard assembly, generally designated 37, which is used to rotatably support a toothed idler roll 38, for a purpose to be described.

The bridge plate 35 also carries an open-ended box-like super structure including a base 40 upright left and right frame plates 41 and 42, respectively, and a cross plate 43, rigidly secured together whereby the plates 41 and 42 are retained in spaced apart parallel relationship to each other. The plates 41 and 42 adjustably support therebetween the upper and lower guide plates 14 and 14*a* in spaced apart parallel relation to each other to provide an entrance guide passage 44 for guiding the preformed strip material into the gathering rolls and to provide the restricted throat passage 16 which guides the gathered strip into the indexing rolls 17 and 17*a*. A curved guide 45 is also suitably secured to the entrance side of this assembly to guide the preformed strip into the passage 44.

The gathering roll 15a is keyed to a shaft 46 journalled in the plates 41 and 42 with the roll 15*a* positioned between these plates, while the gathering roll 15 is keyed to a shaft 47 that is preferably suitably journalled at its opposite ends in a pair of pillow blocks 48 each slidably and adjustably received in one of the plates to permit vertical adjustment of the axis of rotation of the gathering roll 15 relative to the axis of rotation of the gathering roll 15*a*, whereby a tooth form of the gathering roll 15 can overlap the tooth form of the gathering roll 15*a* in a manner to be described. Both the indexing rolls 17 and 17*a* are suitably journalled in the plates 41 and 42, with the roll 17 preferably vertically adjustable in a suitable manner, not shown, whereby the outer peripheral tooth forms of these rolls are in parallel spaced apart relation to each other a predetermined distance so that the teeth on these rolls will effect proper spacing of the fins on the chevron strip material, as previously gathered by the gathering rolls, so that as this strip material is discharged from these indexing rolls, it will have the configuration shown in the right-hand end of the strip material shown in FIG. 7.

The shaft 46 supporting the lower gathering roll 15a has a driven gear tooth pulley 50 fixed to its left-hand end whereby this shaft can be driven by a suitable drive belt 51 encircling the pulley 50 and the pulley 34 fixed to the shaft 27, the belt also engaging the idler roll 38. The other gathering roll 15 fixed to shaft 47 for rotation therewith and the indexing rolls 17 and 17a are driven, in a manner to be described, by the thus driven lower gathering roll shaft 46. This is accomplished by means of gears 52 and 64, as seen in FIG. 9, fixed to the right-hand end of shaft 46 for rotation therewith, gear 64 being positioned outboard of gear 52.

Figure 8:
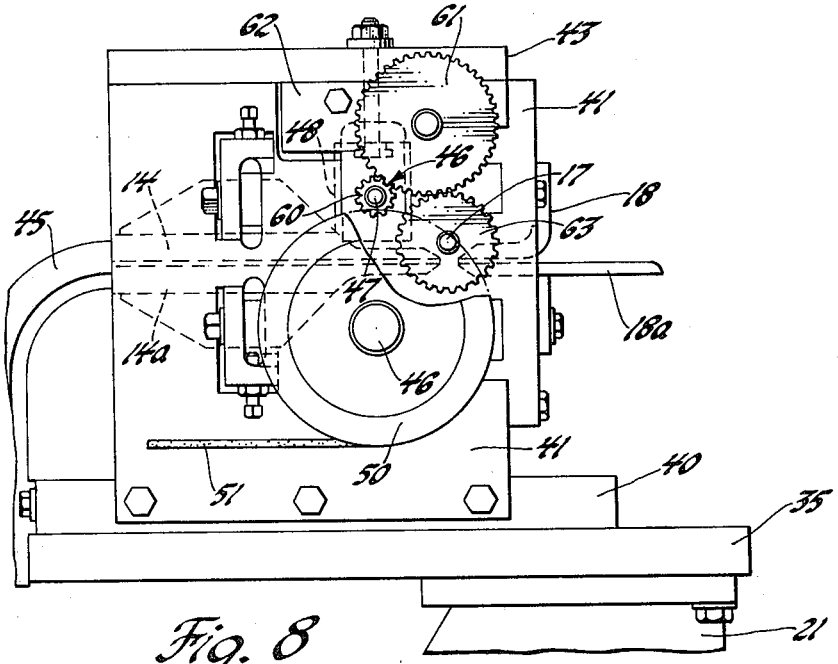
FIG. 8 is a view taken along line 8—8 of FIG. 2.
Figure 9:
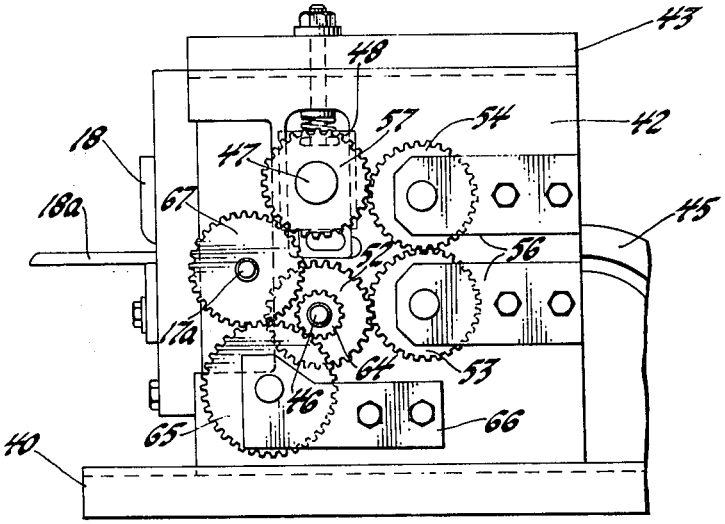
FIG. 9 is a view taken along line 9—9 of FIG. 2.

As best seen in FIG. 9, the gear 52 is in driven engagement, through a pair of intermeshing idler gears 53 and 54 rotatably supported on the pair of idler supports 56 adjustably and pivotably supported on plate 42, with a gear 57 fixed to the right-hand side of the shaft 47 supporting the upper gathering roll 15. As seen in FIG. 8, a gear 60 fixed to the left-hand end of the shaft 47 is in driving engagement with an idler gear 61, rotatably supported on idler support 62 adjustably secured to plate 41, the gear 61 in turn engaging a gear 63 fixed to the left-hand side of the shaft end of index roll 17, whereby the upper index roll is driven. Again referring to FIG. 9, the other or lower index roll **17*a* is driven off the shaft 46 by the gear 64, fixed on this shaft which engages an idler gear 65 that is rotatably supported by idler bracket 66 adjustably secured to plate 42, gear 65, in turn, engaging a gear 67 fixed to the right-hand end of the shaft end of gathering roll 15*a***.

Figure 3:
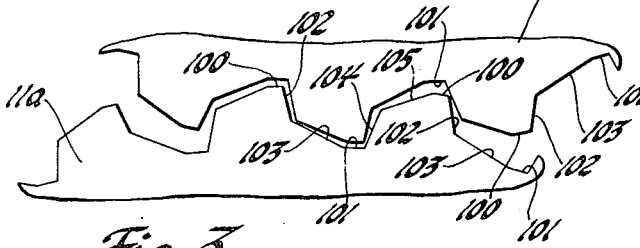
FIG. 3 is an enlarged view of a portion of the preforming rolls of the apparatus of FIG. 1.

Referring now to the tooth form on the preforming rolls, as best seen in FIG. 3, each tooth, using roll **11*a* as an example, since both rolls are similar, would include a flat crest or crown 100 tangential to the outer periphery of the preforming roll and a flat valley or root portion 101 tangential to the root diameter of the roll, the outline of the tooth on one side or leading edge side thereof would have a first straight addendum section 102 starting from the crown 100 to join a first straight dedendum section 103 at a predetermined included angle therebetween and the outline of the trailing edge of the tooth starting from the root portion 101 would have a straight second dedendum section 104 joining a straight second addendum section 105 at a predetermined included angle therebetween, the second addendum 105 joining the flat crest or crown 100 of the tooth. The teeth of the preforming roll 11 would have a tooth form complementary to the tooth form of roll 11*a*. Using the 0.002 inch thick foil for the flat strip material, in the example described, these preforming rolls would first be assembled with their teeth in full contact with respect to each other and then the preform roll 11 would be vertically adjusted 0.0015 inch upward relative to preform roll 11*a***.

Thus, during operation with the teeth of the preforming rolls 11 and **11*a* in meshing engagement with the strip material 1 therebetween and with the above-described predetermined clearance between these rolls, as the flat strip material 1 is fed therebetween, the preforming rolls will partly coin the material and preform the chevron shape and coin the chevron break lines in the strip material. Preferably, the flat crests and valleys are coined with a material thickness reduction of 25% to 30%. As thus formed, the preformed strip 2, as seen in FIG. 7, has the fins 6, the flat crests 7 and the flat valleys 8 formed thereon, but the fins 6** are not as fully bent relative to these flat crests and valleys, as they will be in the final configuration of the chevron strip.

For a reason which will become apparent, each of the gathering rolls 15 and **15*a* is provided with spaced apart annular recessed grooves 107, as seen in FIG. 2, the grooves on one roll being vertically aligned with the grooves on the other roll whereby the longitudinal extending portions of the guide plates 14 and 14*a* which also form the throat opening 16 can extend radially inward of the maximum outer periphery of these rolls. Thus, as seen in FIG. 6, the guide plates 14 and 14*a* extend between these rolls to guide the preformed chevron strip 2 into engagement with the teeth, to be described, of these rolls and for guiding the then discharged gather strip 3**.

Figure 4:
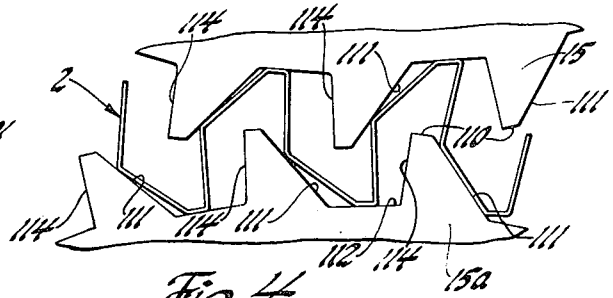
FIG. 4 is an enlarged view of a portion of the gathering rolls of the apparatus of FIG. 1.

As seen in FIG. 4, the lower gathering roll **15*a* has a repeating pattern of teeth about the outer periphery thereof in which each tooth thereof includes a substantially flat crest 110 tangential to the outer diameter of the roll, this flat crest joining an inclined pusher ramp 111 on the leading side of the tooth, the inclined pusher ramp then joining a substantially flat valley portion 112 that is tangential to the root diameter of the roll and this valley portion 112 is connected to an inclined radial ramp 114 which forms the trailing edge of the next adjacent leading tooth form, this radial ramp 114 joining the flat crest 110 on the next adjacent leading tooth form. The upper gathering roll 15 has a corresponding tooth form on the outer periphery thereof and these gathering rolls 15 and 15*a* are positioned relative to each other so that there is a small overlap of the teeth of these rolls. As previously described, these gathering rolls have to be driven in synchronization with each other, as by means of the gears 57 and 52**, respectively, in the manner previously described.

In operation, the pusher ramp 111 which is the leading edge of a tooth of roll **15*a* will push against one fin of the previously formed pre-shaped chevron matrix structure 2 advancing between these rolls while the pusher ramp 111 of the mating tooth of the roll 15 will push against the next adjacent trailing fin being gathered by these rolls. Thus, each tooth of roll 15 will push every other fin of the strip material while roll 15a will push the alternate fins into the restricted throat 16, compressing each of these fins into engagement with the next leading fin, into the shape illustrated at 3 in FIG. 7. Thus, as the preformed strip 2 is advanced between the gathering rolls 15 and 15*a*, the teeth of these rolls are operative to advance the strip material thereby effecting further bending of the fins 6 relative to the flat crests 7 and flat valleys 8, thereby bringing the flat crests 7 into substantial parallel relationship with the flat valleys 8**.

Figure 6:
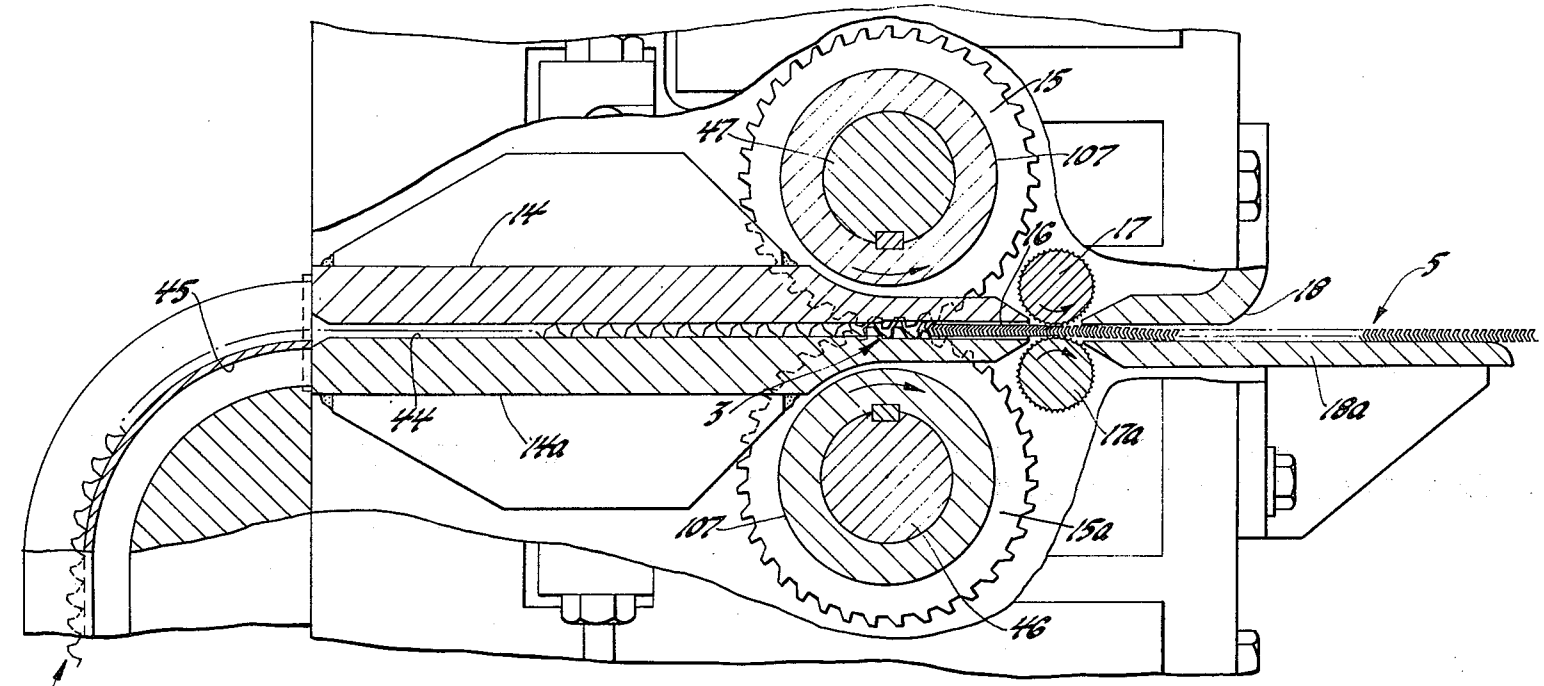
FIG. 6 is an enlarged view, partly in section, of the end of the apparatus of FIG. 1 containing the gathering and indexing rolls.

It should be realized that although the throat 16 has been defined as a restricted throat, even though it is shown larger in cross section in FIG. 6 than the entrance passage formed on the inlet side of the gathering rolls by the plates 14 and **14*a*, it is, in fact, a restricted throat of predetermined height relative to the overall height of the gathered chevron material 3, as seen in FIG. 3. It should also be realized that the illustration in FIG. 6 of the restricted throat 16 is somewhat exaggerated for sake of clarity in illustrating the subject apparatus and, in fact, the restricted throat 16** is only slightly larger than the passage upstream of the gathering rolls.

Figure 5:
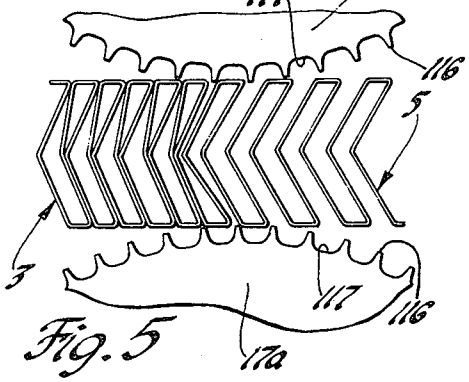
FIG. 5 is an enlarged view of a portion of the indexing rolls of the apparatus of FIG. 1.

The indexing rolls 17 and **17*a*, as seen in FIG. 5, are each provided around their outer periphery with a repeating pattern of teeth 116, with each tooth form of somewhat hypocycloidal configuration and with each tooth separated from the next tooth by a flat recessed space 117 therebetween. The peripheral spacing between adjacent teeth 116 on the roll 17 with the spaces 117 between these teeth corresponding to the spacing of the flat crests 7 on the finished chevron matrix material while the spacing of the teeth on the roll 17***a* would be the same to effect uniform spacing between the flat valleys 8 of the chevron matrix material with the teeth of one indexing roll offset from the teeth of the other indexing roll to effect proper spacing of the flat crests 7 and valleys 8 of the finished matrix strip.

Chevron matrix forming is accomplished in the above described apparatus in two stages, that is, preforming and gathering. The flat metallic foil 1 is fed between the two preforming rolls 11 and 11*a* which preform the chevron shape and coin chevron break lines. The thus prepared (preformed) matrix 2 is fed inbetween the two gathering rolls 15 and 15*a* which feed (gather-form) the matrix, without male or female forming tools, into the accurately defined and controlled passageway or restricted throat 16. At the exit of this passageway, the two indexing rolls 17 and 17*a* are positioned to control (index) the matrix feed-out of the passageway. As shown in the enlarged view in FIG. 6, the chevron matrix material is gathered to a greater density, as seen at 3 in FIG. 7, than shown in the free (not constrained) state, as at 5 in FIG. 7. This gathered (over-form) state of the strip material in the passageway or restricted throat 16 allows for the metal spring-back in the free state. In the over-formed state of the gathered strip 3, the fins 6 are resiliently, slightly, over-bent relative to the flat crests 7 and flat valleys 8, as seen at 3 in FIG. 7.

The gathered state of the matrix in the passageway or restricted throat 16 is achieved and maintained by the gathering rolls feed-in and the indexing rolls feed-out. Stated in other words, the rotational speeds of the gathering and indexing sets of rolls are interrelated, to each other and to the density (fins/inch) of the chevron matrix to effect this feed-in and feed-out. This rotational speed interrelation can be expressed by the following equation:

$$\frac{P_p}{P_f} = K \frac{Ng}{Ni}$$

where:

$P_p$ = Pitch of preformed matrix (see FIG. 7)
$P_f$ = Pitch of finished form matrix (see FIG. 7)
$Ng$ = Speed (RPM) of gathering rolls
$Ni$ = Speed (RPM) of indexing rolls
$K$ = Empirical spring-back factor of material The rotational speed of the preforming rolls relative to the gathering rolls should be such that the feed-out from the preforming rolls corresponds to the feed-in of the gathering rolls so that there is no strain on the web of material between these rolls to effect stretching of the preformed material 2. Preferably, by looping the web of material between these rolls, as shown in FIG. 1, an adequate supply of material feed-out of the preforming rolls is always available for the feed-in to the gathering rolls.

In the embodiment of the apparatus used to fabricate the specific chevron matrix strip 5 described herein, each of the preforming rolls and each of the gathering rolls had a pitch diameter of 2.500 inches with 36 teeth thereon while each of the indexing rolls had an outside diameter of 0.6016 inch, a root diameter of 0.5716 inch with 64 spaces 117 thereon.

What is claimed is:

1. An apparatus for forming an indefinite length of flat strip material into a chevron matrix strip having closely spaced apart parallel fins interconnected to each other at alternating ends, each fin including diagonal first and second fin portions meeting together at an obtuse angle with one end of a fin connected by a flat crest to the next leading fin and the other end of the fin being connected by a flat valley to the next trailing fin, said flat crest and said flat valley being substantially parallel to each other, the apparatus including a frame having upright frame means in spaced apart parallel relation to each other, a pair of preforming rolls, said preforming rolls each having tooth forms on the outer periphery thereof, said preforming rolls being rotatably supported between said upright frame means with said tooth forms thereon in mating engagement with the strip material sandwiched therebetween whereby said preforming rolls will partly deform and coin the strip material into a preformed chevron strip as it passes between said preforming rolls, a pair of annularly grooved gathering rolls, each said gathering roll having complementary-shaped gathering tooth forms on the outer periphery thereon, said gathering rolls being rotatably supported by said frame means with the tooth form on one gathering roll overlapping the tooth form on the other said gathering roll, a predetermined distance, whereby to effect gathering and further forming of the strip material as it passes between said gathering rolls into a gathered over-formed chevron strip, a pair of spaced apart indexing rolls rotatably supported by said upright frame means in spaced apart relation to each other downstream of said gathering rolls in the path of travel of the strip material, a guide means fixed to said upright frame means in position to define a passage to guide said preformed chevron strip through said gathering rolls and to define a restricted throat opening on the discharge side of said gathering rolls to guide said gathered over-formed strip into the bight between said indexing rolls, each of said indexing rolls having a plurality of tooth forms separated by flat recessed spaces on the outer periphery thereof to effect proper spacing and indexing of the previously formed chevron fins on said gathered over-formed strip into said chevron strip, and drive means operatively connected to said preforming rolls, said gathering rolls and to said indexing rolls to effect rotation of said preforming rolls and rotation of said gathering rolls and said indexing rolls at predetermined speeds relative to each other.

2. An apparatus according to claim 1 wherein said tooth form on each of said preforming rolls includes a flat crown tangential to the outer periphery of said preforming roll, a flat root tangential to the root diameter of said preforming roll, with each said flat crown being connected to the next leading flat root by, in succession, a straight leading addendum section and a straight leading dedendum section with a predetermined angle between said leading addendum section and said leading dedendum section and, each said flat crown being connected to the next trailing flat root by, in succession, a straight trailing addendum section and a straight trailing dedendum section with a predetermined angle between said trailing addendum section and said trailing dedendum section.

3. In an apparatus for producing a length of chevron matrix strip from a length of flat strip material fed endwise into the apparatus, the chevron matrix material having closely spaced apart parallel fins interconnected to each other at alternating ends, each fin including diagonal first and second fin portions meeting together at an obtuse angle with one end of a fin connected by a flat crest to the next leading fin and the other end of the fin being connected by a flat valley to the next trailing fin, the flat crest and the flat valleys of the chevron matrix material being substantially parallel to each other, in combination: a frame including upright frame means in spaced apart parallel relation to each other, a pair of preforming rolls rotatably supported by said upright frame means establishing a preforming station, with the axis of said preforming rolls in spaced apart parallel relation to each other, said preforming rolls each having tooth forms on the outer periphery thereof, said tooth forms on one roll meshing with said tooth forms on the other roll with the strip material sandwiched therebetween whereby upon rotation of the deforming rolls, the strip material will be partly deformed into a preformed chevron strip as the strip material is advanced between said preforming rolls, spaced strip material gathering and strip material indexing stations arranged successively and in the order named to first receive the preformed strip to effect further bending and over-forming of the chevron matrix and then indexing the fins of the chevron matrix to provide uniform spacing between adjacent fins of the matrix, a pair of peripherally grooved gathering rolls rotatably supported by said upright frame means defining in part said gathering station, each said gathering roll having gathering tooth forms on the outer periphery thereof and journalled in spaced apart relation to each other such that the tooth form of one gathering roll will mesh with and slightly overlap the tooth form on the other of said gathering roll a predetermined distance whereby to effect gathering and further forming of the preformed strip material as it passes between said gathering rolls into an over-formed chevron matrix strip, a pair of spaced apart indexing rolls rotatably supported by said upright frame means in spaced apart relation to each other downstream of said gathering rolls to define said indexing station, each of said indexed rolls being provided on the outer periphery thereof with a series of equally and circumferentially spaced radial projections with a flat recess space therebetween adjacent projections, said projections of one of said indexing rolls progressively engaging between the fins on opposite sides of the flat crests on one side of the chevron matrix material as it passes between said indexing rolls and the projections on the other of said indexing rolls progressively engaging between adjacent sets of fins on the opposite side of said chevron matrix material, a guide means fixed to said upright frame means in position to provide an inlet guide passage into and through said gathering rolls and a restricted outlet passage on the discharge side of said gathering rolls for guiding the over-formed chevron matrix strip into said indexing rolls, and drive means operatively connected to said preforming rolls, said gathering rolls and to said indexing rolls to effect rotation of said preforming rolls, said gathering rolls and said indexing rolls at predetermined speeds relative to each other.

4. A preforming roll for use in pairs in an apparatus for forming a chevron matrix strip having closely spaced apart parallel fins interconnected to each other at alternating ends, each fin including diagonal first and second fin portions meeting together at an obtuse angle with one end of a fin connected by a flat crest to the next leading fin and the other end of the fin connected by a flat valley to the next trailing fin, with said flat valley being parallel to said flat crest, said preforming roll having a repeating pattern of tooth forms on the outer periphery thereof for mating engagement with the tooth forms on its mating roll with a strip of the material forming the chevron matrix strip therebetween, each said tooth form including a flat crown tangential to the outer periphery of said preforming roll, a flat root tangential to the root diameter of said preforming roll, with each said flat crown being connected to the next leading flat root by, in succession, a straight leading addendum section and a straight leading dedendum section with said leading addendum section being inclined at a predetermined angle relative to said leading dedendum section, and each said flat crown being connected to the next trailing flat root by, in succession, a straight trailing addendum section and a straight trailing dedendum section with said trailing addendum section being inclined at a predetermined angle relative to said trailing dedendum section.

5. The method of fabricating a chevron matrix strip from an indefinite length strip of flat material in a continuous process, said method including the steps of moving the strip of flat material endwise and deforming and coining the material to provide a preformed strip having a repeating pattern of fins, each fin having a chevron break line with the fin portions on opposite sides of the chevron break line partly folded back toward each other in a chevron shape to provide chevron shaped fins, each fin being connected at one end by a flat crest to the next leading fin and connected at its other end by a flat valley to the next trailing fin, gather-forming the thus previously deformed and coined material into an over-formed state with the fins further bent relative to said flat crests and said flat valleys so that said flat crests are then substantially parallel with said flat valleys and so that each fin is in abutment with the next leading fin and the next trailing fin and then progressively indexing each alternate fin on one side of the strip and indexing the opposite alternating fins on the other side of this strip into its final free chevron shape in which the fin portions of adjacent fins on one side of said chevron break line are parallel to each other and the remaining fin portions of said adjacent fins on the other side of said chevron break line are parallel to each other.

* * * * *